US007353581B2

(12) United States Patent
Gallops, Jr. et al.

(10) Patent No.: US 7,353,581 B2
(45) Date of Patent: Apr. 8, 2008

(54) METHOD FOR MANUFACTURING ARCHERY RISERS

(75) Inventors: Henry M. Gallops, Jr., Gainesville, FL (US); James R. Allshouse, Newburgh, IN (US)

(73) Assignee: SOP Services, Inc., Las Vegas, NV (US)

( * ) Notice: Subject to any disclaimer, the term of this patent is extended or adjusted under 35 U.S.C. 154(b) by 559 days.

(21) Appl. No.: 10/970,765

(22) Filed: Oct. 21, 2004

(65) Prior Publication Data

US 2006/0085961 A1 Apr. 27, 2006

(51) Int. Cl.
*B23P 17/00* (2006.01)
*F41B 5/14* (2006.01)

(52) U.S. Cl. ..... 29/412; 29/557; 72/379.2; 124/86; 124/88

(58) Field of Classification Search ..... 29/412, 29/447, 557; 72/379.2; 124/86, 88, 89
See application file for complete search history.

(56) References Cited

U.S. PATENT DOCUMENTS 3,399,560 A * 9/1968 Connolly et al. ..... 72/368
5,141,689 A 8/1992 Simonds
5,291,874 A 3/1994 Harrison
5,335,644 A 8/1994 Smith et al.
5,335,645 A 8/1994 Simonds et al.
5,365,650 A 11/1994 Smith et al.
5,595,168 A 1/1997 Martin
5,697,358 A * 12/1997 Campisi ..... 124/88
5,718,212 A * 2/1998 Allshouse et al. ..... 124/25.6
5,845,388 A 12/1998 Andrews et al.
2004/0060551 A1 4/2004 Gallops
2004/0168852 A1* 9/2004 Jiles et al. ..... 181/171

FOREIGN PATENT DOCUMENTS

JP 55103230 A * 8/1980
JP 05042307 A * 2/1993

OTHER PUBLICATIONS

Edward G. Hoffman, "Production methods" in AccessScience@McGraw-Hill, http://www.accessscience.com, DOI 10.1036/1097-8542.547200, last modified: Aug. 15, 2002.*

* cited by examiner

*Primary Examiner*—Jermie E. Cozart
(74) *Attorney, Agent, or Firm*—Woodard Emhardt Moriarty McNett & Henry LLP

(57) ABSTRACT

In a preferred embodiment of the present invention, a riser for an archery bow is manufactured by providing a flat workpiece, forming the flat workpiece to a pre-bent profile of an archery riser, placing the flat workpiece in a press, and bending the flat workpiece to a desired non-flat shape of the archery riser. Preferably, the flat workpiece is an aluminum sheet in a T4 aluminum condition. Further, after the non-flat shape is created, the riser can optionally be cured to a T6 aluminum condition, a less soft condition.

33 Claims, 6 Drawing Sheets

METHOD FOR MANUFACTURING ARCHERY RISERS

FIELD OF THE INVENTION

The present invention relates generally to archery bows and more particularly pertains to an improved method and apparatus for manufacturing archery risers.

BACKGROUND OF THE INVENTION

A compound archery bow typically comprises a riser, bow limbs, and a bowstring. Archery risers are sometimes referred to as the handle portion of an archery bow, although more precisely a handle portion is part of or connected to a riser frame. Typically upper and lower bow limbs extend from the riser with a bowstring or cable between the limb tips. When the bowstring is drawn, the bow limbs are flexed to store energy. When the bowstring is released, the stored energy propels the arrow. In conventional compound bows, one end of each limb is attached to the bow riser or handle and a rotational member such as a wheel, cam or pulley is mounted on the other end.

There are currently different methods of manufacturing an archery riser. One such method involves machining the archery riser from a solid piece, for example an aluminum billet, by removing material to leave a desired profile and shape. Another method involves die-casting the archery riser using a mold assembly. In another method the archery riser is extruded into the desired profile and shape. The operations are generally costly, mechanically complex, time consuming, and result in a waste of material.

There is a need for an improved method to manufacture archery risers.

SUMMARY OF THE INVENTION

In preferred embodiments, the present invention is concerned with a method and apparatus for manufacturing an archery riser.

A preferred embodiment of the present invention involves a method for manufacturing an archery riser for an archery bow, involving providing a flat workpiece and forming the flat workpiece to a pre-bent profile of an archery riser. The method further involves placing the flat workpiece in a press and bending the flat workpiece to a desired non-flat shape of the archery riser. In one embodiment, the flat workpiece is an aluminum material in a T4 aluminum condition. After forming the workpiece to a non-flat shape, the workpiece can optionally be cured to a hardened state, such as a T6 aluminum condition.

Another preferred method according to the present invention forms an archery riser for an archery bow by providing a flat stock to be formed into an archery riser, cutting the flat stock to a profile defining the approximate pattern of the archery riser, placing the flat stock in a press assembly, and compressing the flat stock in the press assembly to form a desired non-flat shape of the archery riser. Preferably the flat stock is one portion of an aluminum sheet. Further, the aluminum sheet can be divided into two or more portions in order to form two or more archery bow risers.

A further preferred method of the present invention involves a method of manufacturing an archery riser for an archery bow. The method comprises providing a flat stock of aluminum material in a first state to be manufactured into an archery riser, forming the flat stock to a desired pre-bent profile of an archery riser, and providing a die defining a cavity. The cavity has a first surface forming a first shape defining a first riser side to be manufactured and a second surface forming a second shape defining a second riser side to be manufactured. Further steps of a preferred method include placing the flat bar stock in the cavity of the die and pressing the die to change the pre-bent profile of the flat bar stock into a desired non-flat shape of the archery riser conforming to the first and second riser sides.

It is an object of this invention to provide an improved method of manufacturing an archery riser for an archery bow.

Other objects and attendant advantages of this invention will be readily appreciated as the same become more clearly understood by references to the following detailed description when considered in connection with the accompanying drawings in which like reference numerals designate like parts throughout the figures thereof.

DETAILED DESCRIPTION OF PREFERRED EMBODIMENTS

For the purposes of promoting an understanding of the principles of the invention, reference will now be made to the embodiments illustrated and specific language will be used to describe the same. It will nevertheless be understood that no limitation of the scope of the invention is thereby intended, such alterations, modifications, and further applications of the principles of the invention being contemplated as would normally occur to one skilled in the art to which the invention relates.

A method according to the present invention forms an archery riser for use in an archery bow. A preferred method comprises providing a flat workpiece, forming the flat workpiece to a pre-bent profile of an archery riser, placing the flat workpiece in a press, and bending the flat workpiece to a non-flat shape of the archery riser. Preferably the flat workpiece is an aluminum material in a relatively soft, flexible condition. After forming the workpiece to a non-flat shape, the workpiece can optionally be cured to a more hardened state.

Figure 1:
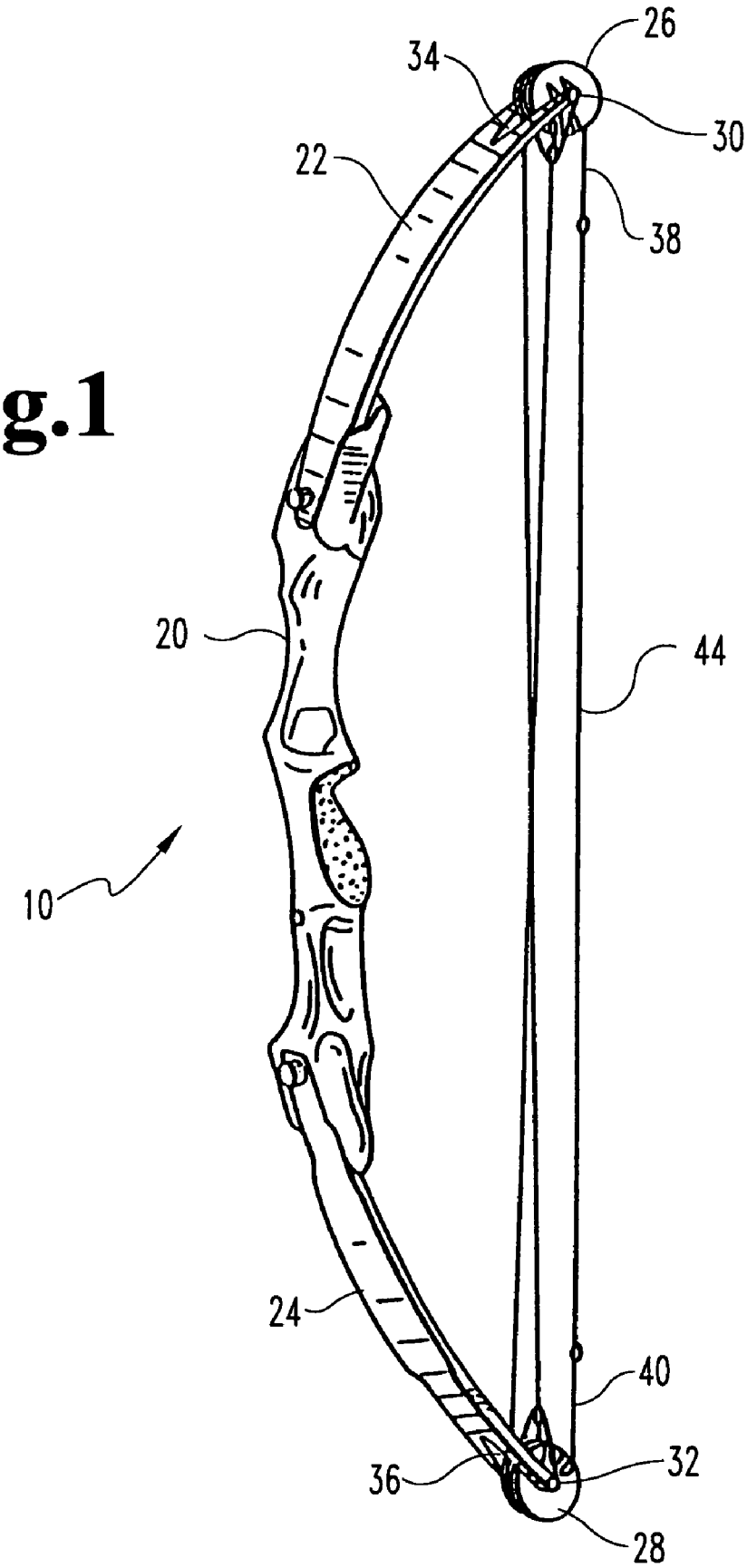
FIG. 1 is a perspective view of a compound archery bow.

FIG. 1 illustrates one example of a conventional compound archery bow generally designated as 10. When viewed from the perspective of an archer holding the bow 10, it includes a riser 20 with an upper limb portion 22 and a lower limb portion 24. The archery riser 20 is one example of an archery riser that can be manufactured by the method of the present invention. Rotational members forming variable leverage units such as eccentric pulleys 26 and 28 are supported at the limb tip sections for rotary movement about axles 30 and 32. In the embodiment shown, the upper pulley axle 30 is carried in a slot between the outer limb tip portions 34 of upper limb 22. The lower pulley axle 32 is carried in a slot between the outer limb tip portions 36 of lower limb 24.

Bowstring 44 includes upper end 38 and lower end 40 which are fed-out from pulleys 26 and 28 when the bow is drawn. The extended cable portions of bowstring 44 are mounted around pulleys 26 and 28 as is known in the art.

When the bowstring 44 is drawn, it causes eccentric pulleys 26 and 28 at each end of the bow to rotate, feeding out bowstring cable while limb portions 22 and 24 are bent inward, causing additional energy to be stored therein. When the bowstring 44 is released with an arrow engaged to the bowstring, the limb portions 22 and 24 return to their rest position, causing the eccentric pulleys 26 and 28 to rotate in the opposite direction, to take up the bowstring 44 and launch the arrow with an amount of energy proportional to the energy initially stored in the bow limbs. Bow 10 is described for illustration and context and is not intended to be limiting. The present invention can be used in conjunction with dual-cam compound bows, or can be used in conjunction with single-cam bows as described for example in U.S. Pat. No. 5,368,006 to McPherson, hereby incorporated herein by reference, or can be used in other pulley/cam arrangements. The present invention can also be used in conjunction with other types of bows, which are considered conventional for purposes of the present invention.

Figure 2:
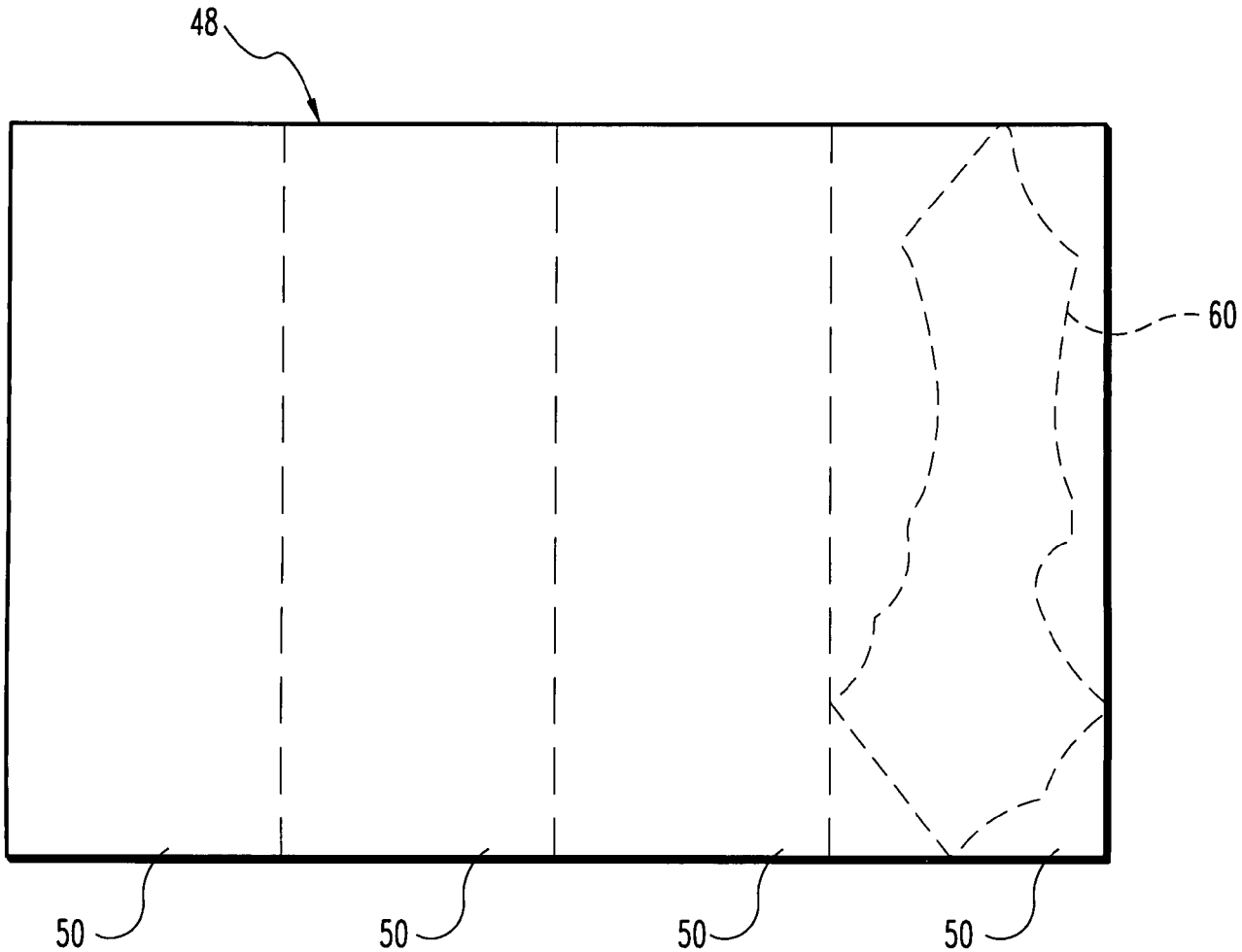
FIG. 2 is a top view of a sheet.

FIG. 2 illustrates a sheet 48 of material. The sheet 48 can be divided into multiple flat workpieces 50. In a preferred embodiment, the sheet 48 is dividable into two or more portions, such as flat stocks or flat workpieces 50, and the two or more portions may be individually manufactured into two or more corresponding archery risers or various archery bow components. In the illustrated embodiment, the sheet 48 is divided into four such portions. However, the sheet 48 may be divided into the number of portions as would occur to one skilled in the art. Additionally, the portions may be arranged on the sheet 48 as would occur to one skilled in the art.

The flat workpiece 50 is preferably an aluminum alloy. Aluminum alloys can include temper designations. Aluminum alloy products which are thermally treated are typically designated with a "T" temper designation. A T4 temper designation indicates that the aluminum alloy has been solution heat treated and naturally aged. A T6 temper designation indicates that the aluminum alloy has been solution heat treated and then artificially aged. A T6 aluminum alloy is in a more hardened state than a T4 aluminum alloy. Therefore, processes often involve allowing an aluminum alloy to naturally age to a T4 condition and then artifically aging the alloy to a T6 condition. In a preferred embodiment, the flat workpiece 50 is a solid piece of aluminum alloy material in a T4 condition. An aluminum workpiece in a T4 condition is in a softer, more flexible condition and thus better suited for the method of the present invention, being less likely to shatter, lose strength, and/or become more brittle during application in a die press or similar machine than a material in a more hardened state. However, it should be appreciated that other appropriate materials may be used as the flat workpiece 50 as would occur to one skilled in the art.

To begin the manufacturing process of an archery riser, a flat or pre-bent pattern or profile 60 of an archery riser is formed from the flat workpiece 50. In a preferred embodiment, the pre-bent profile 60 is cut or ground using a cutting head or laser from the flat workpiece 50 using a computerized numerically controlled ("CNC") process. However, it should be understood that other processes can be used to form the pre-bent profile 60 as would generally occur to one skilled in the art.

Figure 3A:
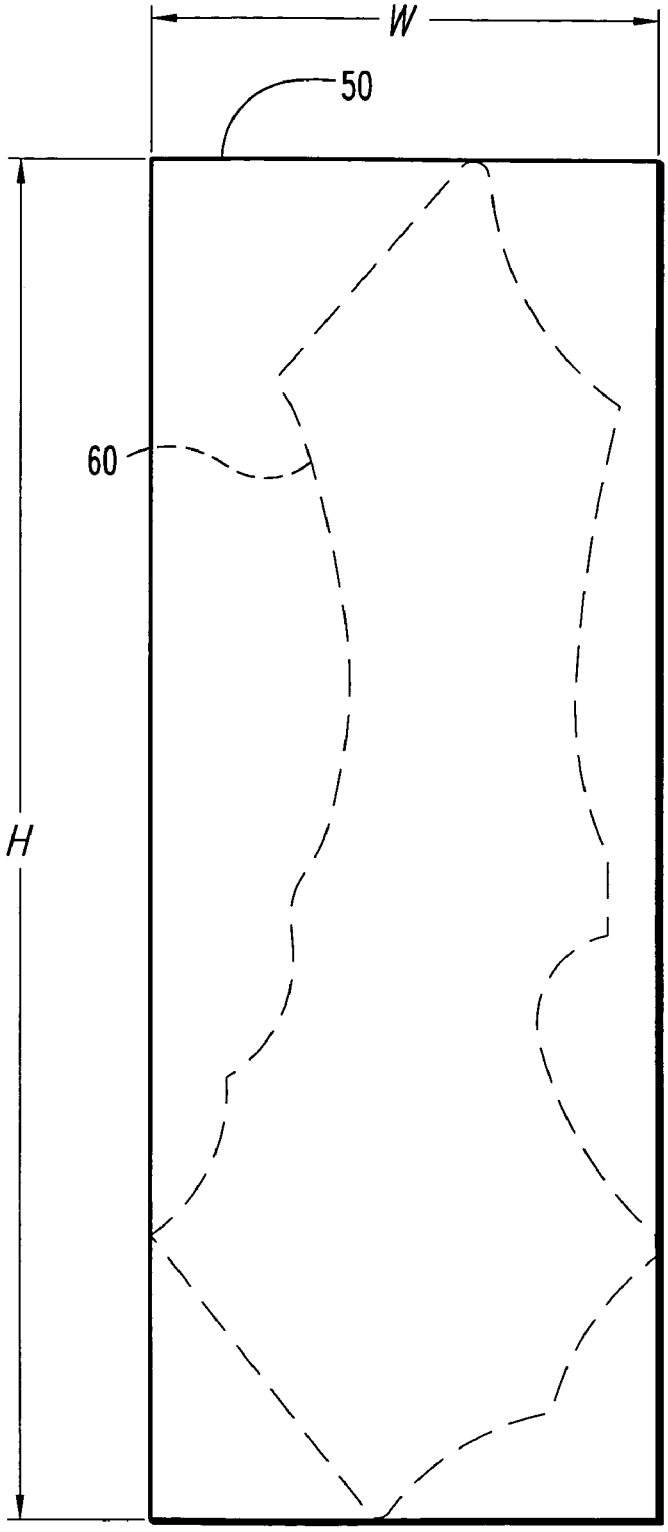
FIG. 3A is a top view of a flat workpiece.
Figure 3B:
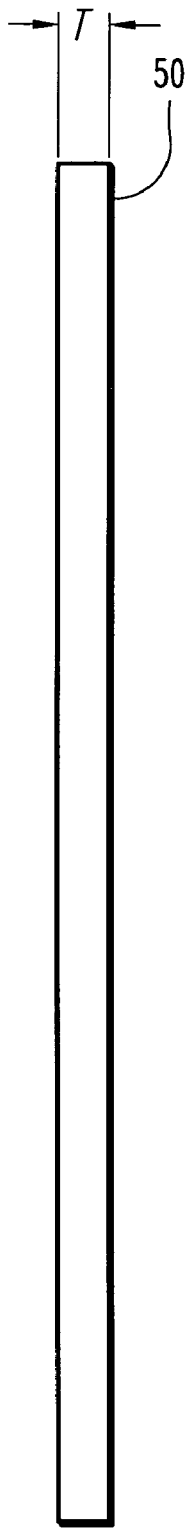
FIG. 3B is a side view of a flat workpiece.

FIG. 3A illustrates a top view of a flat workpiece 50. The flat workpiece 50 has a height H and a width W. The height H and the width W of the flat workpiece 50 is preferably substantially equal to the maximum height and width of the pre-bent profile 60. FIG. 3B is a side view of the flat workpiece 50 and the pre-bent profile 60, illustrating a solid thickness T of the flat workpiece 50. The thickness T of the flat workpiece 50 is preferably substantially equal to the thickness of the pre-bent profile 60. In one embodiment, the flat workpiece 50 is approximately one-half of an inch thick. In another embodiment, the flat workpiece 50 is approximately five-eighths of an inch thick. The flat workpiece 50 can be of a selected thickness as desired for the final application, such as to control the strength of the archery riser in an adult-sized archery bow or a child-sized archery bow.

Figure 4:
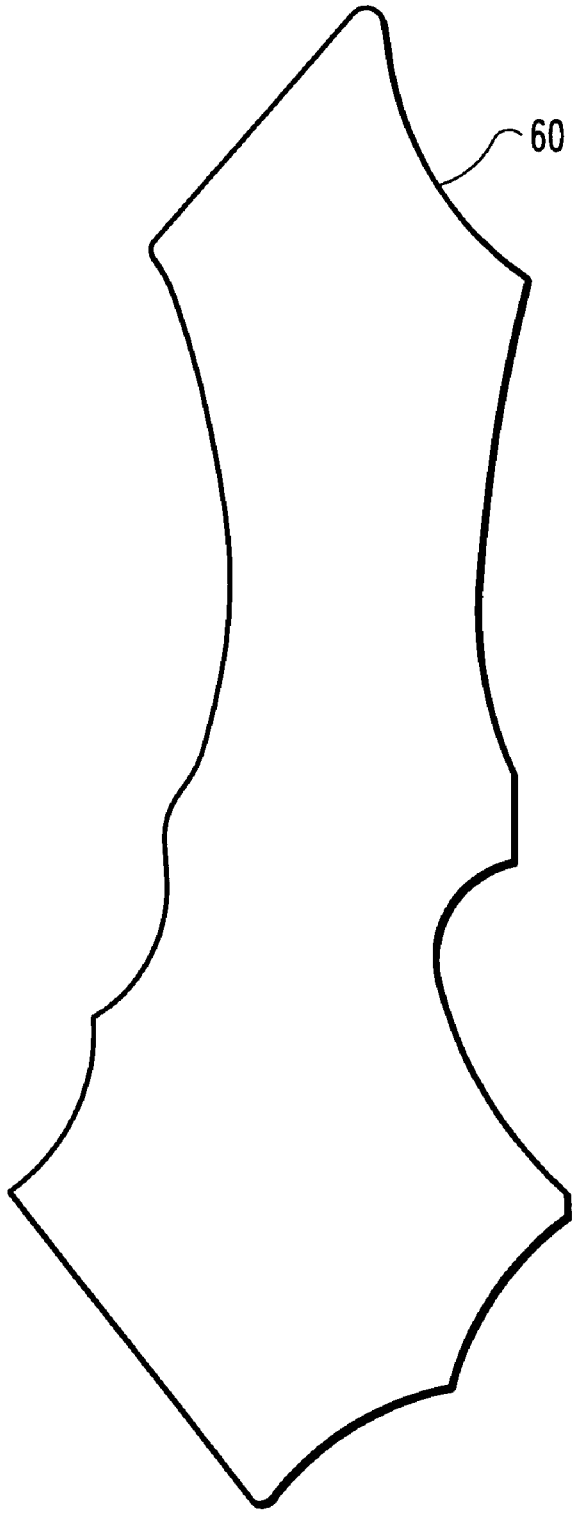
FIG. 4 is a top view of a flat profile of an archery riser according to the present invention.

FIG. 4 illustrates the pre-bent profile 60 of an archery riser after being cut from the flat workpiece 50. The pre-bent profile 60 has not yet been bent or shaped to its final configuration of an archery riser. Further, the pre-bent profile 60 is an approximate pattern of an archery riser. The profile and shape will change after the pre-bent profile 60 is bent to a desired configuration of an archery riser by a press or other such device. Additionally, the pre-bent profile 60 preferably includes material allowances or tolerances at the necessary locations to ensure that the desired dimensions of an archery riser will result along the riser's length after the pre-bent profile 60 is bent or shaped. For example, the resulting archery riser may be shorter than the pre-bent profile 60, due to several turns and radii, thus the change in length and radii must be accounted for in determining the dimensions of the pre-bent profile 60 to be used.

Figure 5:
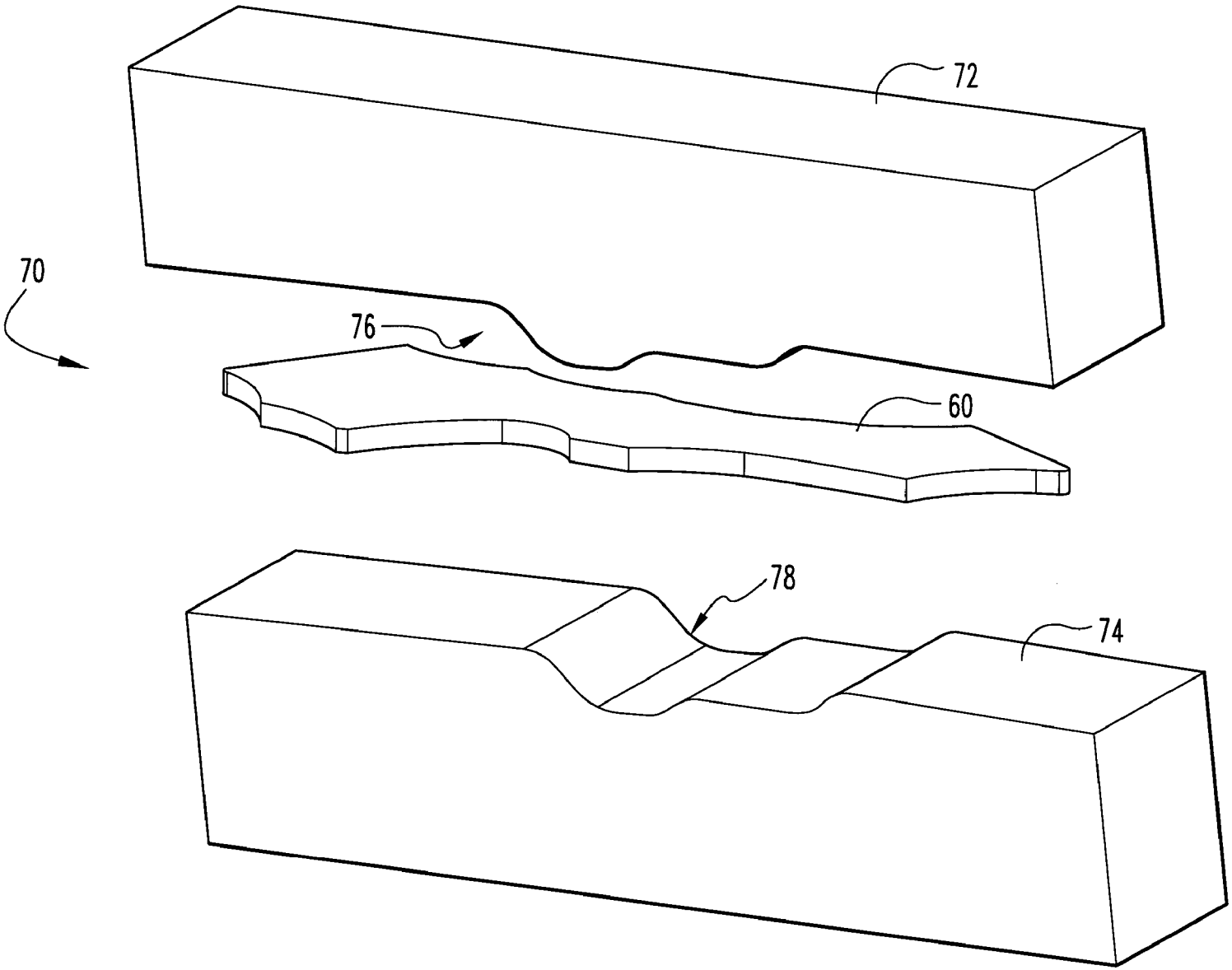
FIG. 5 is a perspective view of a flat profile of an archery riser and a die press assembly, according to the present invention.

When the pre-bent profile 60 is in a suitable condition to be bent or shaped, it is inserted into a press assembly 70, as illustrated in FIG. 5. The press assembly 70 is typically a die press or other such similar device defining a cavity. The press assembly 70 is designed with a cavity to operate to form a desired non-flat shape of an archery riser upon insertion of a piece of material, such as the pre-bent profile 60, and operation of the press assembly 70. The press assembly 70 typically includes an upper die member 72, defining an upper contour 76, and a lower die member 74, defining a lower contour 78. Upon insertion into the press assembly 70, the pre-bent profile 60 is preferably received on and positioned in relation to the lower contour 78. The press assembly 70, including upper die member 72 and lower die member 74, is positioned so that the pre-bent profile 60 extends longitudinally between the upper contour 76 and the lower contour 78.

Figure 6:
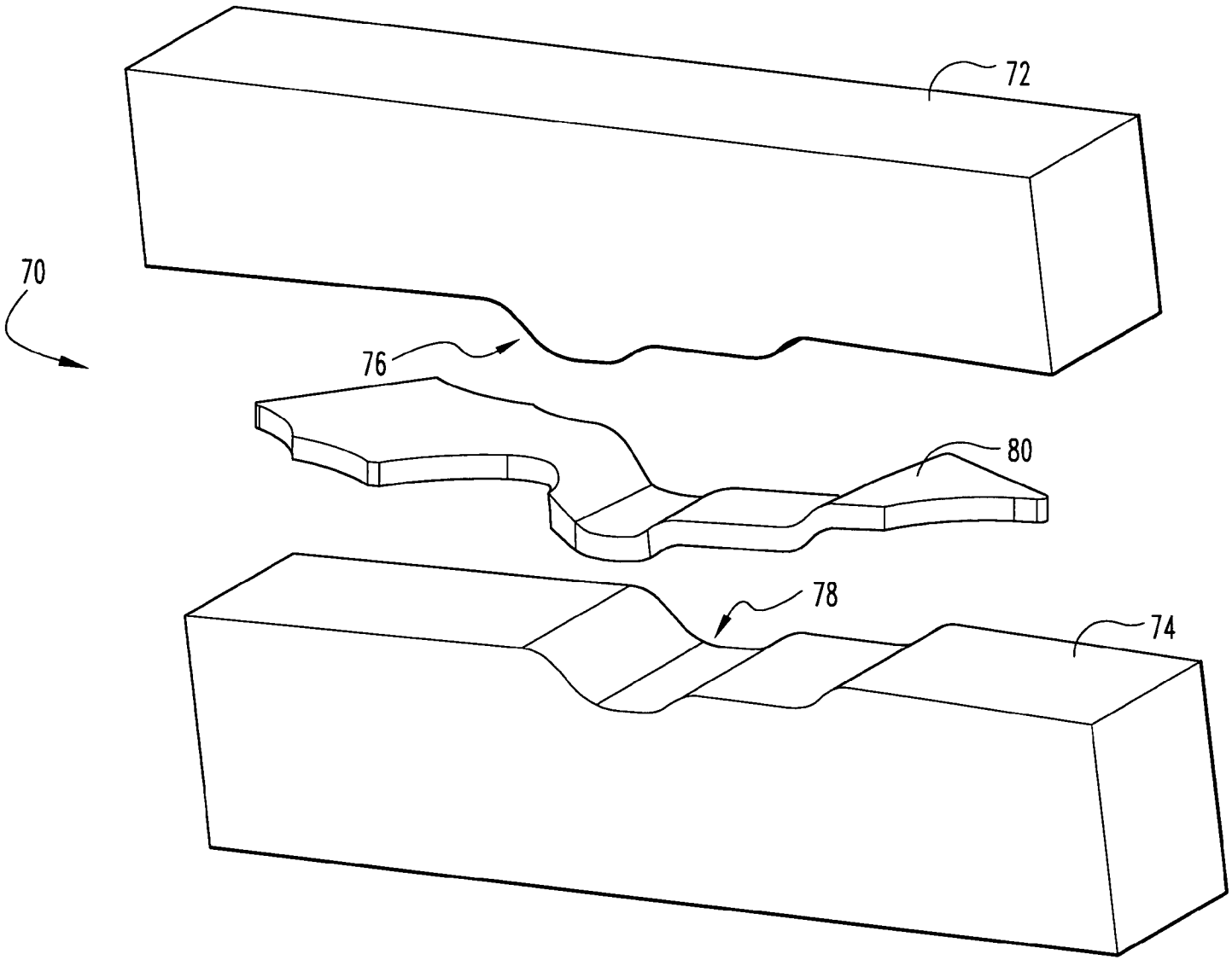
FIG. 6 is a perspective view of a non-flat shape of an archery riser and a die press assembly, according to the present invention.

As illustrated in FIG. 6, the lower contour 78 of the lower die member 74 in conjunction with the mating upper contour 76 of upper die member 72 are shaped to form the pre-bent profile 60 into a shaped archery riser 80, after operation of the press assembly 70. Preferably the upper contour 76 presses the pre-bent profile 60 into the lower contour 78, and preferably the press assembly 70 compresses the pre-bent profile 60 into the shaped archery riser 80. In one example, the press assembly 70 uses at least 80 tons of force. It should be appreciated that the orientation, placement and shape of the upper and lower contours can be configured as desired and as would occur to one skilled in the art. After compressing, the upper die member 72 and the lower die member 74 are separated and the shaped archery riser 80 is removed from the press assembly 70.

Placing the pre-bent profile 60 in the press assembly 70 in a first orientation and compressing the pre-bent profile 60 creates a shaped archery riser 80 appropriate for a right-handed archery bow. Preferably, placing the pre-bent profile 60 in the press assembly 70 in a second orientation, and compressing the pre-bent profile 60 creates a shaped archery riser 80 appropriate for a left-handed archery bow. In one embodiment, the first orientation is a first side contacting the upper die member 72 and a second side contacting the lower die member 74, and the second orientation is the first side contacting the lower die member 74 and the second side contacting the upper die member 72. Thus, optionally the same press assembly 70 may be used to create both left-handed and right-handed shaped archery risers 80.

Further, slight adjustments and finishing can be made to the shaped archery riser 80 by any appropriate method as would generally occur to one skilled in the art. In one embodiment, the edges of the shaped archery riser 80 are machine ground to smooth the edges and to make any necessary adjustments. Crafting the exact desired profile and shape of the archery riser may also involve forming rounded corners and radiused edges. Additionally, after the shaped archery riser 80 has been formed, holes are often drilled in the shaped archery riser 80 to remove weight or for mounting sights and other accessories of an archery bow. The shaped archery riser 80 can be polished, decorated or otherwise enhanced by methods that would generally occur to one skilled in the art and then incorporated into an archery bow.

After being formed into a bent profile, the shaped archery riser 80, still in a T4 aluminum condition, may be cured to a T6 aluminum condition if desired or necessary. This will cause the shaped archery riser 80 to assume a more hardened state than the T4 aluminum condition, as discussed above. In one embodiment, the shaped archery riser 80 is cured by being placed in an oven not to exceed 350 degrees Fahrenheit for a period of approximately 6 hours.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A method for manufacturing an archery riser for an archery bow, comprising:

a. providing a flat workpiece;

b. cutting the flat workpiece to a pre-bent profile of an archery riser;

c. placing the flat workpiece in a press; and d. pressing the press to form the flat workpiece to a non-flat, finished shape of the archery riser sized to final dimensions, wherein the cutting is completed prior to the pressing, wherein the pre-bent profile of the flat workpiece includes material allowances to obtain final dimensions of the archery riser upon the pressing without the need for final machining after the pressing.

2. The method of claim 1, wherein the flat workpiece provided is comprised of an aluminum material in a T4 condition.

3. The method of claim 1, wherein the press is pressed with at least eighty tons of force.

4. The method of claim 1, further comprising curing the flat workpiece to a hardened state.

5. The method of claim 4, wherein the flat workpiece provided is comprised of an aluminum material in a T4 condition and the hardened state is a T6 condition.

6. The method of claim 1, further comprising:

providing an aluminum sheet; and dividing the aluminum sheet into two or more portions, wherein the flat workpiece is one of the two or more portions.

7. The method of claim 6, wherein the two or more portions are manufactured into two or more archery risers.

8. The method of claim 1, wherein the flat workpiece has a thickness of at least one half of an inch.

9. The method of claim 8, wherein the flat workpiece has a thickness of at least five eighths of an inch.

10. The method of claim 1, further comprising drilling holes in the non-flat shape of the archery riser.

11. The method of claim 1, further comprising polishing the non-flat shape of the archery riser.

12. A method for manufacturing an archery riser for an archery bow, comprising:

providing a flat stock to be formed into an archery riser;

cutting the flat stock to a profile defining an approximate pattern of the archery riser;

placing the flat stock in a press assembly; and compressing the flat stock in the press assembly to form a desired non-flat, finished shape of the archery riser sized to final dimensions, wherein the cutting is completed prior to the compressing, wherein the profile of the flat stock includes material allowances to obtain final dimensions of the archery riser upon the compressing without the need for final machining after the compressing.

13. The method of claim 12 wherein the flat stock is an aluminum alloy in a first state.

14. The method of claim 13, wherein the first state is a T4 aluminum alloy.

15. The method of claim 13, further comprising curing the flat stock to a second state after compressing the flat stock.

16. The method of claim 15, wherein the second state is a T6 aluminum alloy.

17. The method of claim 12, further comprising:

providing an aluminum sheet; and dividing the aluminum sheet into two or more portions, wherein the flat stock is one of the two or more portions.

18. The method of claim 17, wherein the two or more portions are manufactured into two or more archery risers.

19. The method of claim 12, wherein the flat stock has a thickness of at least one-half of an inch.

20. The method of claim 12, wherein the flat stock has a thickness of at least five eighths of an inch.

21. The method of claim 12, wherein placing the flat stock in the press assembly in a first orientation and compressing the flat stock creates an archery riser appropriate for a right-handed archery bow.

22. The method of claim 21, wherein placing the flat stock in the press assembly in a second orientation and compressing the flat stock creates an archery riser appropriate for a left-handed archery bow.

23. A method of manufacturing an archery riser for an archery bow, comprising the steps of:

a. providing a flat stock of aluminum material in a first state to be manufactured into an archery riser;

b. cutting the flat stock to a desired pre-bent profile of an archery riser;

c. providing a die defining a cavity, the cavity having a first surface forming a first shape of a first riser side to be manufactured, and the cavity having a second surface forming a second shape of a second riser side to be manufactured;

d. placing the flat stock in the cavity of the die; and e. pressing the die to change the pre-bent profile of the flat stock into a desired non-flat, finished shape of the archery riser sized to final dimensions and conforming to the first and second riser sides, wherein the cutting is completed prior to the pressing, wherein the pre-bent profile of the flat stock includes material allowances to obtain final dimensions of the archery riser upon the pressing without the need for final machining after the pressing.

24. The method of claim 23, further comprising curing the flat stock to a first state.

25. The method of claim 24, further comprising curing the flat stock to a second state.

26. The method of claim 25, wherein the second state is T6 aluminum.

27. The method of claim 24, wherein the first state is T4 aluminum.

28. The method of claim 23, wherein the flat stock is one portion of a flat workpiece, the flat workpiece being divided into two or more portions, and an archery bow component being formed from each of the two or more portions.

29. The method of claim 23, wherein placing the flat stock in the die in a first orientation and compressing the flat stock creates an archery riser appropriate for a right-handed archery bow.

30. The method of claim 23, wherein placing the flat stock in the die in a second orientation and compressing the flat stock creates an archery riser appropriate for a left-handed archery bow.

31. The method of claim 23, wherein the die includes an upper die member and a lower die member.

32. The method of claim 31, wherein pressing the die includes pressing the upper die member and the lower die member together.

33. The method of claim 32, further comprising separating the upper die member and the lower die member and removing the archery riser.

* * * * *